US011384466B2

(12) United States Patent
Jung et al.

(10) Patent No.: US 11,384,466 B2
(45) Date of Patent: Jul. 12, 2022

(54) LAUNDRY TREATING APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 100 days.

(21) Appl. No.: 16/749,571

(22) Filed: Jan. 22, 2020

(65) Prior Publication Data

US 2020/0232134 A1 Jul. 23, 2020

(30) Foreign Application Priority Data

Jan. 22, 2019 (KR) ..... 10-2019-0008281

(51) Int. Cl.

| | |
|---|---|
| ***D06F 33/37*** | (2020.01) |
| ***D06F 39/02*** | (2006.01) |
| ***D06F 33/57*** | (2020.01) |
| ***D06F 105/42*** | (2020.01) |
| ***D06F 103/22*** | (2020.01) |
| *D06F 103/00* | (2020.01) |
| *D06F 103/44* | (2020.01) |

(52) U.S. Cl.

CPC ..... *D06F 33/37* (2020.02); *D06F 33/57* (2020.02); *D06F 39/02* (2013.01); *D06F 39/022* (2013.01); *D06F 39/028* (2013.01); *D06F 2103/00* (2020.02); *D06F 2103/22* (2020.02); *D06F 2103/44* (2020.02); *D06F 2105/42* (2020.02)

(58) Field of Classification Search

CPC ..... D06F 33/37; D06F 33/57; D06F 39/02; D06F 39/022; D06F 39/028; D06F 2103/00; D06F 2103/22; D06F 2103/44; D06F 2105/44

See application file for complete search history.

(56) References Cited

U.S. PATENT DOCUMENTS

| | | | | | |
|---|---|---|---|---|---|
| D788,391 | S | * | 5/2017 | Kim | D32/29.1 |
| D809,724 | S | * | 2/2018 | Yoon | D32/29.1 |
| D828,661 | S | * | 9/2018 | Joo | D32/29.1 |

(Continued)

FOREIGN PATENT DOCUMENTS

| | | | |
|---|---|---|---|
| CN | 205313862 U | * | 6/2016 |
| DE | 112005000830 | | 3/2020 |

(Continued)

OTHER PUBLICATIONS

Machine translation of CN-205313862-U to Wang. (Year: 2016).*

Office Action in German Appln. No. 102020200475, dated Mar. 30, 2022, 11 pages (with English translation).

*Primary Examiner* — Joseph L. Perrin

(74) *Attorney, Agent, or Firm* — Fish & Richardson P.C.

(57) ABSTRACT

The present disclosure relates to a laundry treating apparatus, including a housing configured to supply laundry detergent to the tub and define an outer appearance; a storage container disposed to extend in a front-rear direction of the main body to store the laundry detergent, and mounted to the housing; a laundry detergent pump provided at a rear portion of the housing to define a movement of laundry detergent stored in the storage container; and a remaining amount sensing unit that applies a current toward an inside of the storage container to sense a remaining amount of laundry detergent stored in the storage container.

11 Claims, 12 Drawing Sheets

(56) References Cited

U.S. PATENT DOCUMENTS

| | | | | |
|---|---|---|---|---|
| 2010/0000578 | A1* | 1/2010 | Hendrickson | D06F 39/028 134/34 |
| 2016/0194813 | A1* | 7/2016 | Kurtkaya | D06F 39/022 134/115 R |
| 2016/0273150 | A1* | 9/2016 | Del Pos | D06F 39/02 |
| 2017/0191205 | A1* | 7/2017 | Jung | D06F 39/022 |
| 2017/0191206 | A1* | 7/2017 | Jung | F04B 13/02 |
| 2017/0233931 | A1* | 8/2017 | Lee | D06F 39/022 68/17 R |
| 2019/0153657 | A1* | 5/2019 | Clayton | D06F 39/088 |

FOREIGN PATENT DOCUMENTS

| | | |
|---|---|---|
| DE | 112005000831 | 3/2020 |
| EP | 2733249 | 5/2014 |

* cited by examiner

LAUNDRY TREATING APPARATUS

CROSS-REFERENCE TO RELATED APPLICATION

Pursuant to 35 U.S.C. § 119(a), this application claims the benefit of an earlier filing date of and the right of priority to Korean Patent Application No. 10-2019-0008281, filed on Jan. 22, 2019, the contents of which are incorporated by reference herein in its entirety.

BACKGROUND

1. Technical Field

The present disclosure relates to a laundry treating apparatus having a detergent supply apparatus.

2. Description of the Related Art

The laundry treating apparatus is an apparatus for putting clothing, bedding or the like (hereinafter, referred to as laundry) into the drum to remove contamination from the laundry. The laundry treatment apparatus may perform the processes of washing, rinsing, dehydrating, drying and the like, and the laundry treatment apparatus may be divided into a top loading type and a front loading type based on a method of putting laundry into a drum.

The laundry treating apparatus may generally include a main body defining an outer appearance, a tub received into the main body, a drum rotatably mounted inside the tub to put laundry thereinto, and a detergent supply apparatus for supplying detergent into the drum. When the drum is rotated by the motor while wash water is supplied to the laundry received in the drum, dirt adhered to the laundry may be removed by a friction with the drum and the wash water.

The detergent supply apparatus is provided with a laundry detergent supply function of supplying detergent or laundry detergent (hereinafter, referred to as "laundry detergent") to enhance the washing effect.

Here, the laundry detergent means a substance that enhances the washing effect, such as textile detergent, fabric softener, and fabric bleach. For the laundry detergent, powder type laundry detergent or liquid type laundry detergent may be used.

In recent years, there is a problem in that the detergent component is not dissolved after washing and remains in the water tank or the laundry, and thus, the use of liquid laundry detergent with excellent solubility instead of powder type laundry detergent is gradually increased.

However, a laundry treating apparatus in the related art has inconvenience because the user has to open a door and then manually puts laundry detergent into a detergent storage container provided inside the door in order to supply the laundry. In addition, in the related art, injected laundry detergent is put into the tub by way of water supplied through a water passage, but it is difficult for the user to know how much laundry detergent is stored since the detergent storage container is provided inside the door, and there is a problem that the detergent storage container stored with laundry detergent should be frequently opened.

SUMMARY

A first aspect of the present disclosure is to provide a structure of a laundry treatment apparatus capable of storing a large amount of laundry detergent in a detergent supply apparatus and automatically supplying the stored laundry detergent to a drum.

A second aspect of the present disclosure is to provide a structure of a laundry treatment apparatus capable of automatically sensing the remaining amount of laundry detergent stored in the detergent supply apparatus, thereby enhancing a user's convenience.

A third aspect of the present disclosure is to provide a structure of a laundry treatment apparatus capable of easily replenishing laundry detergent through the detergent supply apparatus when the laundry detergent stored in the detergent supply apparatus is insufficient.

A fourth aspect of the present disclosure to provide a structure of a laundry treatment apparatus capable of conveniently separating or combining the detergent supply apparatus for the replenishment and washing of laundry detergent.

In order to achieve an objective of the present disclosure, a laundry treating apparatus having the foregoing structure may include a tub provided inside a main body and a drum rotatably provided inside the tub; and a detergent supply apparatus provided to be inserted into or withdrawn from a front surface of the main body, and configured to supply laundry detergent to the tub, wherein the detergent supply apparatus includes a housing defining an outer appearance; a storage container disposed to extend in a front-rear direction of the main body to store the laundry detergent, and mounted to the housing; a laundry detergent pump provided at a rear portion of the housing to define a movement of laundry detergent stored in the storage container; and a remaining amount sensing unit that applies a current toward an inside of the storage container to sense a remaining amount of laundry detergent stored in the storage container.

According to an example of the present disclosure, the remaining amount sensing unit may include a terminal provided to protrude from the main body toward the storage container; and an electrode sensor fixedly provided at a storage container lid portion that opens and closes an upper portion of the storage container, one side of which is provided to be in contact with the terminal to transmit a current to laundry detergent stored in the storage container.

According to an example of the present disclosure, the detergent supply apparatus may further include a wash water dispenser fixedly provided inside the main body, and located such that a bottom surface thereof faces an upper portion of the storage container to define a moving path of wash water flowing in from the outside when the housing is mounted to the main body.

According to an example of the present disclosure, the wash water dispenser may include a dispenser cover disposed with a wash water passage in a predetermined shape along the surface to guide a movement of wash water flowing in along a wash water inlet portion; and a dispenser lid coupled to cover an upper portion of the dispenser cover.

According to an example of the present disclosure, the terminal and the electrode sensor may be respectively configured in plurality.

According to an example of the present disclosure, the terminal may include an extension portion fixedly provided at one side of the dispenser cover; and a contact portion configured to be bent from the extension portion so as to be in contact with the electrode sensor.

According to an example of the present disclosure, the extension portion may be fixedly provided at one side of the dispenser cover, and the contact portion may be configured to protrude through an opening portion of the dispenser cover so as to be selectively in contact with one side of the electrode sensor.

According to an example of the present disclosure, the electrode sensor may include a horizontal portion fixed to the storage container lid portion, one side of which is configured to be exposed to the outside so as to be in contact with the contact portion; and a vertical portion that is bent from the horizontal portion to extend in a direction crossing the horizontal portion toward an inside of the storage container.

According to an example of the present disclosure, the electrode sensor may be provided with an electrode to be in contact with laundry detergent at a lower end portion of the vertical portion.

According to an example of the present disclosure, the storage container may include a first storage container and a second storage container which are provided to face each other at one side of the housing, and a manual detergent dispensing unit is disposed between the first storage container and the second storage container to manually put laundry detergent therein by a user.

According to an example of the present disclosure, a third detergent container that guides the input of laundry detergent by the user may be mounted to the manual detergent dispensing unit.

According to an example of the present disclosure, a lower surface of the housing may be disposed to be inclined to move the laundry detergent, and a detergent input hole may be disposed at one side of the lower surface to communicate with the tub.

According to an example of the present disclosure, a lower side portion of the housing may be disposed to have a predetermined inclination toward the detergent input hole.

According to an example of the present disclosure, a discharge port may be disposed at a rear portion of the storage container to discharge laundry detergent stored by the operation of the laundry detergent pump, and laundry detergent flowing out through the discharge port may be mixed with incoming wash water to move toward the tub.

The effects of the present disclosure obtained through the above-described solutions are as follows.

First, the detergent supply apparatus may be mounted with storage containers for storing different laundry detergent, respectively, to store a large amount of laundry detergent. In addition, it may be possible to automatically supply an appropriate amount of laundry detergent to the tub through the operation of the laundry detergent pump in the washing process, and if necessary, the user may directly put a desired amount of laundry detergent into the manual detergent dispensing unit, thereby further enhancing the user's convenience.

Second, through a contact between the terminal provided at one side of the wash water dispenser and the electrode sensor provided at one side of the storage container, the remaining amount of laundry detergent stored in the storage container may be automatically sensed to notify the user of the information, thereby enhancing the user's convenience.

Third, according to laundry detergent sensed through the remaining amount sensing unit, when the laundry detergent stored in the detergent supply apparatus is insufficient, the detergent supply apparatus may be withdrawn from the main body to open a plug, thereby allowing the user to easily replenish the laundry detergent.

Fourth, when withdrawing the housing, it may possible to easily remove the storage container provided in the housing, thereby further facilitating the replenishment and washing of laundry detergent.

DETAILED DESCRIPTION OF THE EMBODIMENTS

Hereinafter, a laundry treating apparatus associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, the detailed description will be omitted when specific description for publicly known technologies to which the invention pertains is judged to obscure the gist of the present disclosure.

It should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

Figure 1:
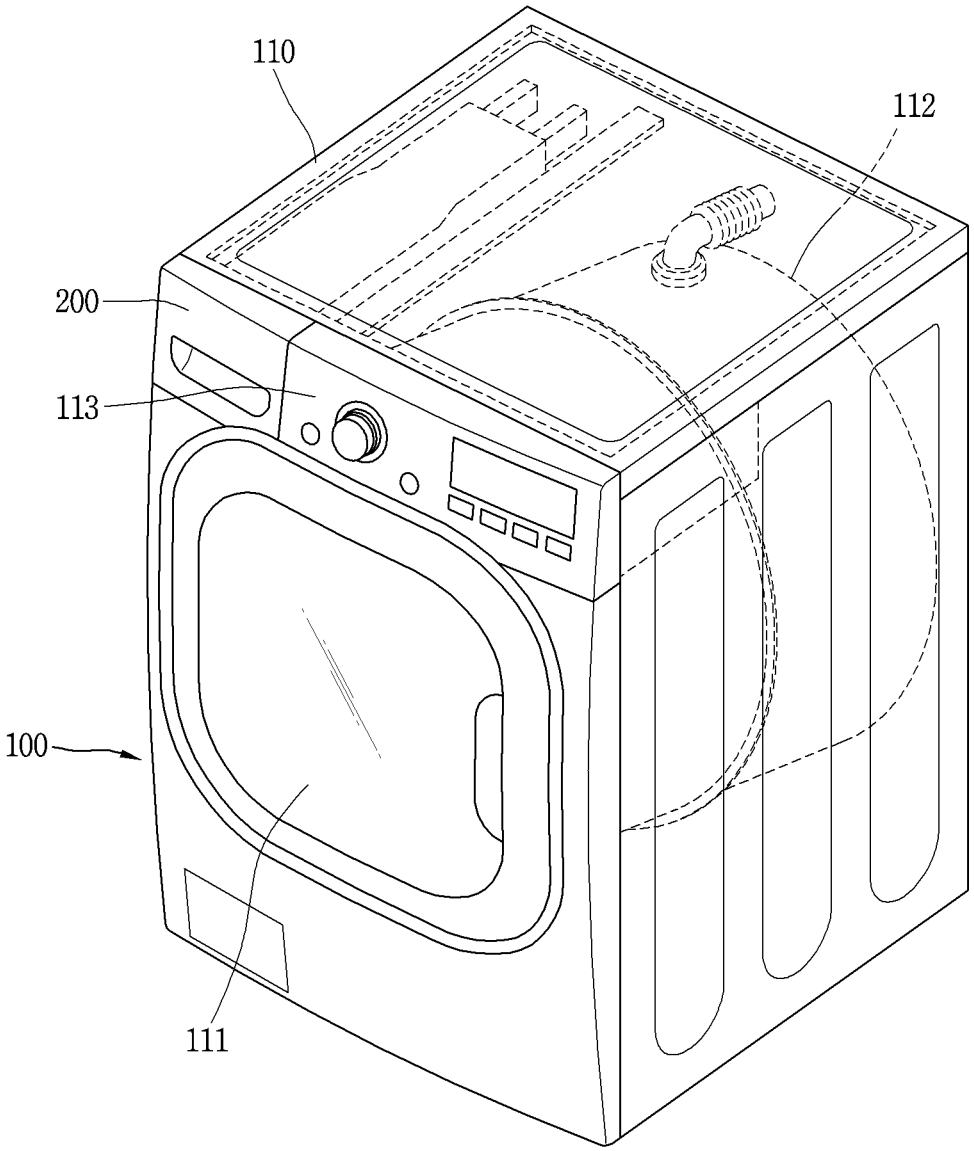
FIG. 1 is a perspective view illustrating a laundry treating apparatus according to the present disclosure.

FIG. 1 is a perspective view illustrating a laundry treating apparatus according to the present disclosure.

The laundry treating apparatus 100 may include a washing machine for inserting fabric into a washing tub to perform washing, rinsing, dehydration, and the like and a dryer for inserting wet fabric to perform drying.

The laundry treating apparatus may be divided into a top load type and a front load type. FIG. 1 illustrates a front load type laundry treating apparatus, for the sake of convenience of explanation, and the technical concept of the present disclosure may not be applicable only to a front load type washing machine, and thus may also be applicable to a top load type washing machine.

As shown in FIG. 1, the laundry treating apparatus 100 has a structure including a main body 110 defining an outer appearance, an operation unit 113 that receives various control commands from a user and has a display unit displaying information on an operation state, and a door 111 rotatably provided at a front portion of the main body 110 to allow the entry and exit of laundry.

The main body 110 may define an outer appearance of the laundry treating apparatus 100, and may be provided with a space capable of receiving various components constituting the laundry treating apparatus 100 inside the main body 110. A drum 112 that receives laundry loaded through the door 111 may be provided inside the main body 110.

The drum 112 may include an outer tub (not shown) filled with wash water, and an inner tub (not shown) provided to be rotatable inside the outer tub (not shown) to receive laundry. One side of the drum 112 may be provided with a balancer (not shown) to compensate for eccentricity caused by rotation.

The operation unit 113 may include various keys for operating the operation state of the laundry treating apparatus 100 and a display for displaying the operation state of the laundry treating apparatus 100.

The door 111 is to open and close a fabric entrance hole, and may be made of a transparent member such as tempered glass to look inside the main body 110.

Furthermore, the laundry treatment apparatus 100 according to the present disclosure may include a detergent supply apparatus 200.

The detergent supply apparatus 200 may be provided at an upper one side of the main body 110. The detergent supply apparatus 200 may store laundry detergent having a broader concept including detergent and fabric softener to automatically supply the laundry detergent into the drum 112 in the washing process. Here, the laundry detergent denotes a material capable of enhancing the washing effect of laundry, and may denote liquid fabric detergent and liquid fabric softener.

Figure 2:
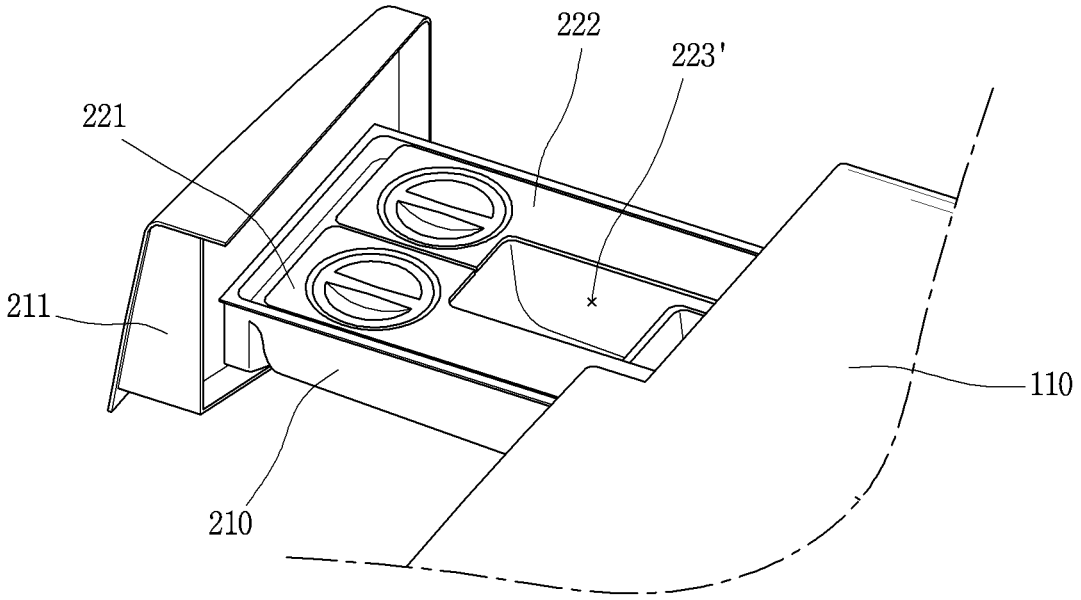
FIG. 2 is a conceptual view showing a state in which a detergent supply apparatus is withdrawn from a main body.

FIG. 2 is a conceptual view illustrating a state in which the detergent supply apparatus 200 is withdrawn from the main body 110. The detergent supply apparatus 200 may include a housing 210 defining an appearance, and storage containers 221, 222 mounted to the housing 210. When the user grips a front portion 211 of the housing 210 and then pulls it out, the detergent supply apparatus 200 may be withdrawn out in a sliding manner from a front portion of the main body 110. Similarly, when the user pushes the front portion of the housing 210 toward the main body 110, the detergent supply apparatus 200 may be inserted into the main body 110 while sliding in a direction toward the main body.

However, in order for the user to withdraw the detergent supply apparatus 200 from the main body to replenish laundry detergent in the storage containers 221, 222 or to supply laundry detergent to a manual detergent dispensing unit 223', the plugs 224 of the storage containers 221, 222 and the manual detergent dispensing unit 223' must be made to be exposed to the outside when the detergent supply apparatus 200 is withdrawn from the main body.

The first storage container 221 and the second storage container 222 configured to store different laundry detergents may be mounted inside the housing 210. In addition, the manual detergent dispensing unit 223' for manually supplying laundry detergent by a user may be disposed between the first storage container 221 and the second storage container 222.

The plugs 224 may be provided in the first storage container 221 and the second storage container 222, respectively. The plugs 224 may be removed from the storage containers 221, 222 when rotated in one direction. When the plugs 224 are removed from the storage containers 221, 222, the user will be able to supply laundry detergent to the storage containers 221, 222.

In other words, when a lack of laundry detergent is sensed on the operation panel 113 of the laundry treatment apparatus 100, the housing 210 is withdrawn out, and then the plugs 224 coupled to the storage containers 221, 222 exposed to the outside are gripped, and then removed by rotating them in one direction to replenish the laundry detergent in the storage containers 221, 222.

Figure 3A:
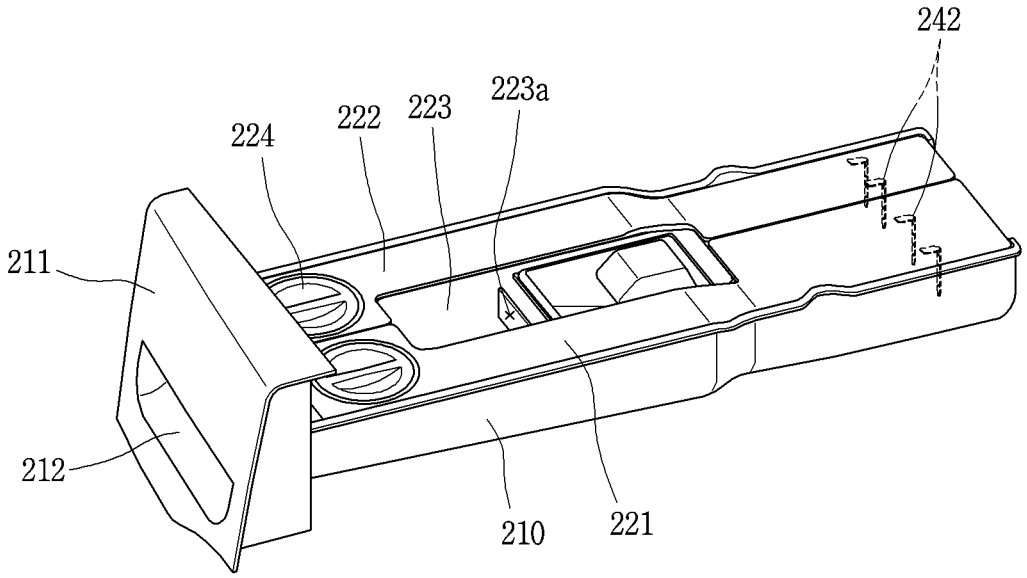
FIG. 3A is a perspective view showing a state in which the detergent supply apparatus is completely withdrawn out to the outside.
Figure 3B:
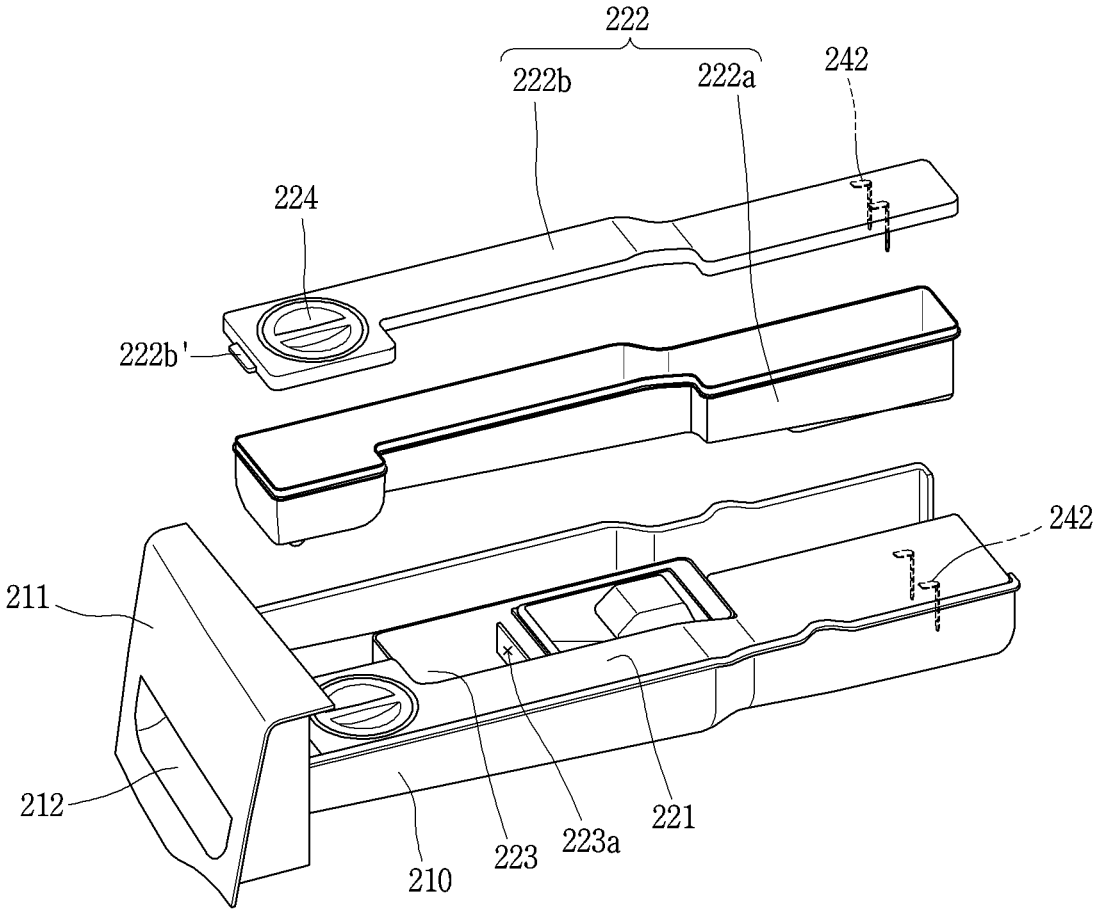
FIG. 3B is an exploded perspective view of the detergent supply apparatus in FIG. 3A.

FIG. 3A is a perspective view showing a state in which the detergent supply apparatus is completely withdrawn out to the outside, and FIG. 3B is an exploded perspective view of the detergent supply apparatus in FIG. 3A.

The detergent supply apparatus 200 may be made to be withdrawn from or inserted into the main body 110 by the user. When the user grips the front portion 211 of the housing 210 and then pulls it out, the detergent supply apparatus 200 may be withdrawn out while sliding from the front part of the main body 110. When the detergent supply apparatus 200 is withdrawn from the main body 110, the storage containers 221, 222 may be exposed to the outside.

The detergent supply apparatus 200 may include a housing 210 defining an outer appearance, and storage containers 221, 222 mounted to the housing 210.

The housing 210 defines an outer appearance of the detergent supply apparatus 200, and may be defined in a shape that is open at an upper end thereof. The housing 210 may be defined in a shape extending in a front-rear direction of the main body 110, and a plurality of storage containers 221, 222 may be mounted in a receiving space defined inside the housing 210.

The storage containers 221, 222 may include a first storage container 221 and a second storage container 222. The first storage container 221 and the second storage container 222 may be defined in a shape of a container extending in a front-rear direction of the main body 1110, and provided with a space capable of storing a predetermined amount of laundry detergent therein.

The first storage container 221 and the second storage container 222 may be defined in a "⊏"-shape, and the first storage container 221 and the second storage container 222 may be mounted inside the housing 210 in a shape facing each other.

Different laundry detergents may be stored inside the first storage container 210 and the second storage container 220. For example, fabric softener may be stored in the first storage container 210 and liquid detergent may be stored in the second storage container 220, respectively.

A lower surface of the first storage container 221 and the second storage container 222 may be disposed have a predetermined inclination, thereby facilitating the flow of the laundry detergent received in each of the storage containers 221, 222. The laundry detergent stored in each of the storage containers 221, 222 must be supplied toward the tub through the laundry detergent pump 230, it may be disposed to be inclined with a constant inclination toward the rear side.

Each of the storage containers 221, 222 may include a receiving portion 221*a*, 222*a* in which laundry detergent is received and a storage container lid portion 221*b*, 222*b* configured to cover each receiving portion 221*a*, 222*a* to limit an external exposure of the laundry detergent. Furthermore, the storage container lid portion 221*b*, 222*b* may be provided with the foregoing plug 224 to allow the user to replenish laundry detergent through the removal of the plug 224 without removing the storage container lid portion 221*b*, 222*b*. In addition, a front end of each of the storage container lid portion 221*b*, 222*b* may be disposed with a protrusion 222*b*' configured to protrude toward the front portion, thereby allowing the user to hold it to more easily remove the storage container lid portion 221*b*, 222*b*.

Moreover, as shown in FIG. 3A, the first storage container 210 and the second storage container 220 may be mounted at one side of the housing to face each other, and thus the manual detergent dispensing unit 223' may be disposed between the first storage container 210 and the second storage container 220, thereby allowing the user to manually put laundry detergent therein.

Besides, the manual detergent dispensing unit 223' may be configured to mount a third storage container 223 so as to guide the input of laundry detergent by the user, and the third storage container 223 may be divided into two regions through a boundary portion defined at a center portion thereof, thereby allowing the user to put fabric softener to one side, and to put detergent to the other side as a manual mode.

Figure 4:
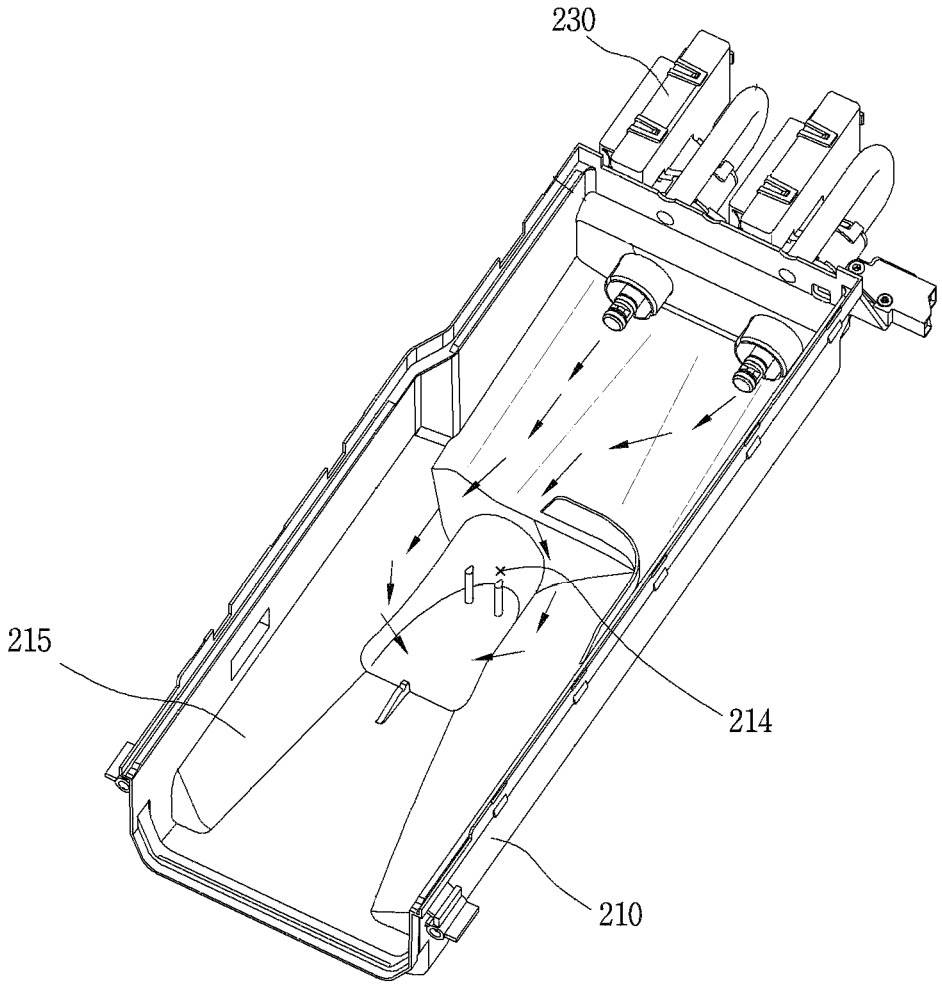
FIG. 4 is a perspective view showing a state of a housing.

FIG. 4 is a perspective view showing a state of the housing 210.

The detergent input hole 214 may be disposed at a lower center portion of the housing 210. The detergent input hole 214 is made to communicate with the tub (not shown) of the laundry treating apparatus 100, and thus laundry detergent mixed with wash water may be moved along an inclined lower surface of the housing 210, and then supplied into the tub (not shown) through the detergent input hole 214.

As shown in FIG. 4, an inclined portion 215 having a predetermined inclination may be disposed at a lower surface portion of the housing 210 to face the detergent input hole 214. The laundry detergent pump 230 may be provided at a rear portion of the housing 210 to define a movement of laundry detergent stored in the storage containers 221, 222.

Specifically, a discharge port (not shown) may be disposed to protrude at a rear portion of each storage container 221, 222 so as to discharge the stored laundry detergent by the operation of the laundry detergent pump 230, and the discharge port may be coupled to the laundry detergent pump 230. The laundry detergent moved from each storage container 221, 222 to an inside of the housing 210 through the discharge port (not shown) may be mixed with wash water flowing into the housing 210, and then supplied to the tub (not shown) through the detergent input hole 214 as shown in an arrow direction of FIG. 4.

Furthermore, the laundry treatment apparatus 100 according to the present disclosure will be able to sense whether laundry detergent stored in each storage container is insufficient through a remaining amount sensing unit 240. The detailed description thereof will be described later.

Figure 5A:
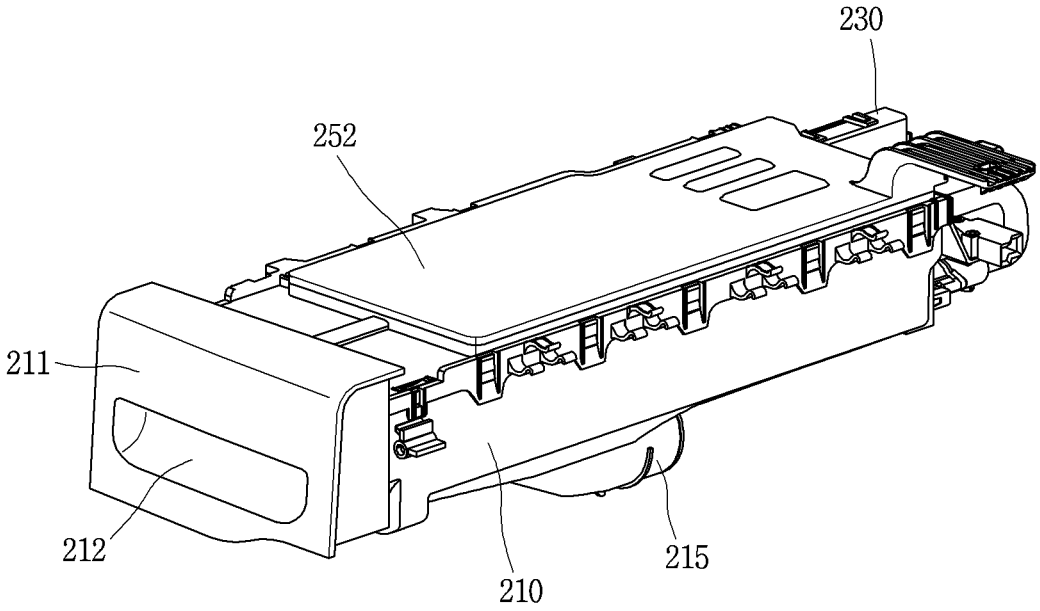
FIG. 5A is a conceptual view showing a state in which the detergent supply apparatus is inserted into the main body.
Figure 5B:
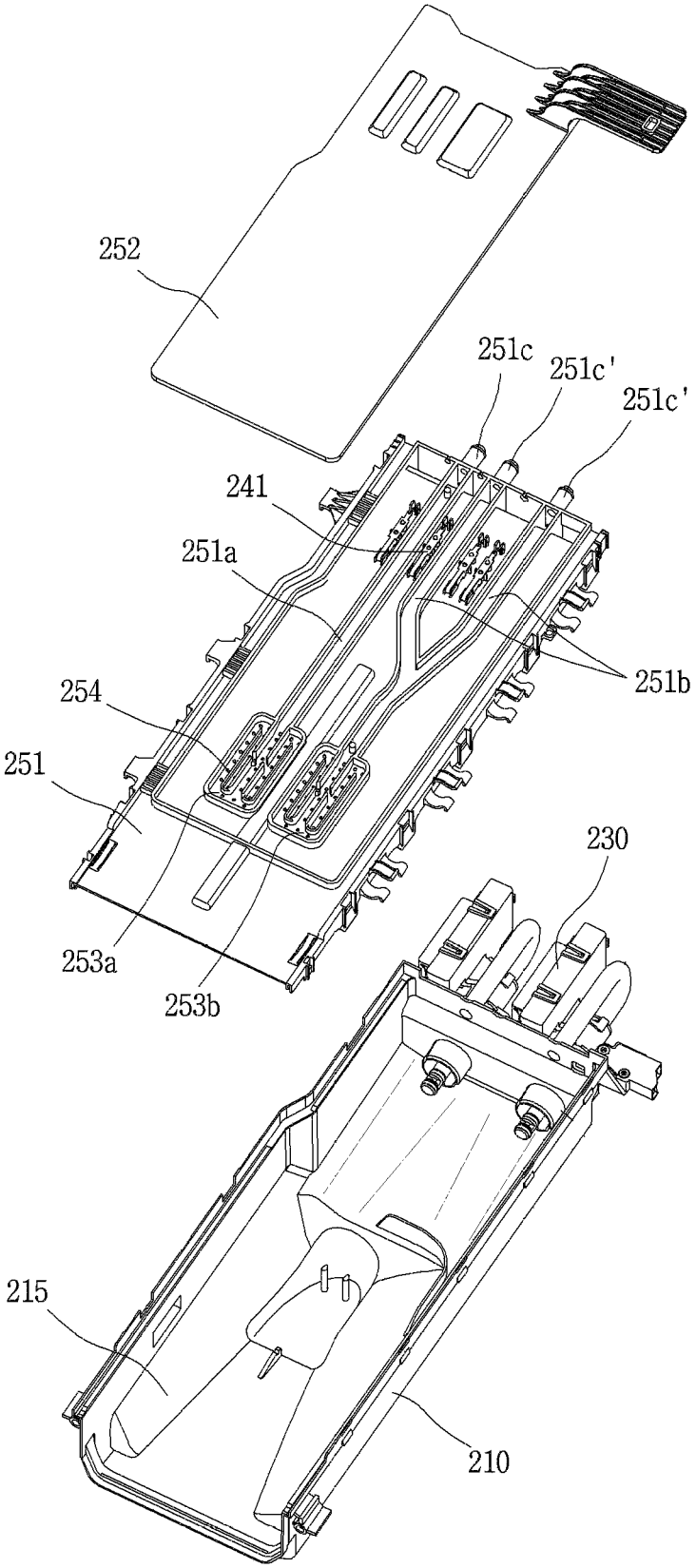
FIG. 5B is an exploded view of the detergent supply apparatus in a state where a storage container is removed in FIG. 5A.

FIG. 5A is a conceptual view showing a state in which the detergent supply apparatus 200 is inserted into the main body 110, and FIG. 5B is an exploded view of the detergent supply apparatus 200 in a state where the storage containers 221, 222 are removed in FIG. 5A.

A wash water dispenser 250 may be fixed to the main body 110 of the laundry treatment apparatus. When the housing 210 is inserted into the main body, the wash water dispenser 250 may be located above the housing 210 to have the structure of FIG. 5A.

The wash water dispenser 250 serves to define a moving path of wash water flowing therein. When the housing 210 is mounted to the main body 110, the wash water dispenser 250 provided inside the main body 110 may be located to face each storage container 221, 222 mounted to the housing 210.

The wash water dispenser 250 may include a dispenser cover 251 and a dispenser lid 252 disposed to cover the dispenser cover.

The dispenser cover 251 may be disposed with wash water passages 251*a*, 251*b* extending along the surface to guide the movement of wash water flowing in along a wash water inlet portion 251*c*.

The wash water passages 251*a*, 251*b* may be disposed on a rear surface of the dispenser cover 251 to communicate with the wash water inlet portions 251*c*, 251*c*' passing through the inside and the outside so as to allow wash water to flow therein. The wash water passages 251*a*, 251*b* may be defined by both sidewalls extending uniformly. When the dispenser lid 252 is coupled to the dispenser cover 251, it is defined a closed space allowing wash water to move, and thus wash water may move toward each wash water receiving portion 253*a*, 253*b* along the wash water passage 251*a*, 251*b*.

A plurality of wash water passages 251*a*, 251*b* may be provided. Each of the wash water passages 251*a*, 251*b* may extend toward each of the wash water receiving portions 253*a*, 253*b* disposed at one side surface of the dispenser cover 251.

The wash water passage 251*a*, 251*b* may include a first wash water passage 251*a* and a second wash water passage 251*b*. The first wash water passage 251*a* may communicate with one wash water inlet portion 251*c* to allow wash water to flow therein. The first wash water passage 251*a* may serve to guide the movement of the wash water toward the first wash water receiving portion 253*a*.

The first wash water receiving portion 253*a* may be provided with a space in which wash water temporarily moving along the first wash water passage 251*a* is temporarily received. A plurality of wash water moving holes 254 may be disposed in the first wash water receiving portion 253*a*, and wash water received in the first wash water receiving portion 253*a* may be discharged through the wash water moving hole 254.

When the housing 210 is inserted into the main body 110, the first wash water receiving portion 253*a* may be located to overlap with one partitioned region of the third storage container 223 provided in the manual detergent dispensing unit 223' of the housing 210 in a vertical direction.

At this time, liquid detergent or powder detergent put into the third storage container 223 may be mixed with wash water and then supplied to the tub while moving downward through the wash water moving hole 254 disposed in the first wash water receiving portion 253*a*.

When the housing 210 is inserted into the main body 110, the second wash water receiving portion 253*b* may be located to overlap with another partitioned region of the third storage container 223 provided in the manual detergent dispensing unit 223' of the housing 210 in a vertical direction.

Fabric softener put into the third storage container 223 may be mixed with wash water and then supplied toward the tub while moving downward through a plurality of wash water moving holes 254 disposed in the second wash water receiving portion 253*b*.

The dispenser lid 252 may have a rectangular plate shape, and may be coupled to the dispenser cover 251. When the dispenser lid 252 is coupled to the dispenser cover 251, each of the wash water passages 251*a*, 251*b* disposed in the dispenser cover 251 may be closed.

In addition, in the present embodiment, the detergent supply apparatus 200 may be provided with the remaining amount sensing unit 240 to sense a remaining amount of laundry detergent stored in the first and second storage containers 221, 222, and then notify the user of the information, thereby enhancing the user's convenience. When the remaining amount of laundry detergent sensed through the remaining amount sensing unit 240 is less than a predetermined capacity, the user may withdraw the detergent supply apparatus 200 from the main body and open the plug 224, and then conveniently replenish laundry detergent.

When the detergent supply apparatus 200 is mounted to the main body, the remaining amount sensing unit 240 may apply a current to an inside of each storage container 221, 222, and then measure the sensed current, thereby sensing a remaining amount of laundry detergent stored inside the each storage container 221, 222.

The remaining amount sensing unit 240 may be configured with a terminal 241 and an electrode sensor 242. The terminal 241 may be provided at one side of the dispenser cover 251, and the electrode sensor 242 may be provided at each lid portion 221*b*, 222*b* of the first and second storage containers 221, 222.

Figure 6:
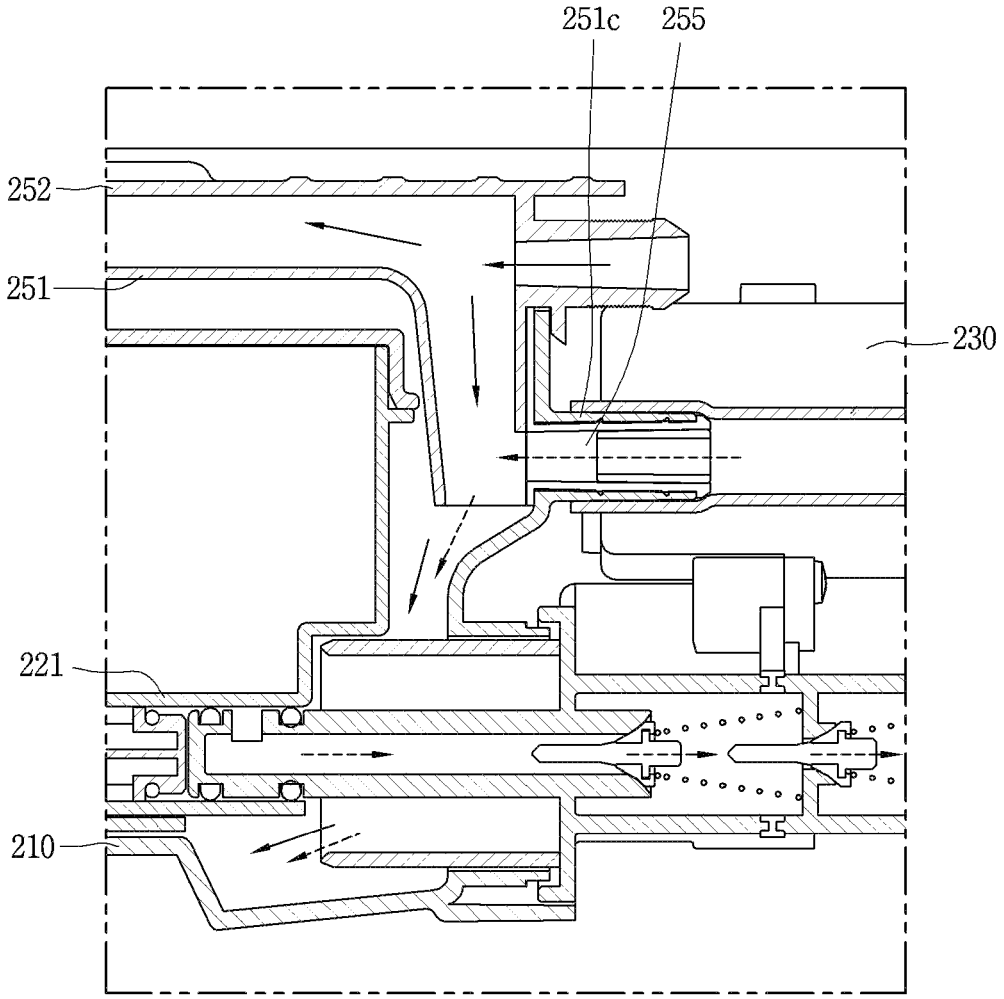
FIG. 6 is a cross-sectional view showing a state in which laundry detergent and wash water are mixed.

FIG. 6 is a cross-sectional view showing a state in which laundry detergent and wash water are mixed.

A discharge port (not shown) for discharging the stored laundry detergent by the operation of the laundry detergent pump 230 may be disposed at a rear portion of each storage container 221, 222. The laundry detergent flowing out through the discharge port (not shown) may be introduced into a side portion of the housing 210, and the introduced laundry detergent may be mixed with wash water to move toward the tub.

Wash water may be introduced through the wash water inlet portion 251*c*, 251*c*" disposed in the dispenser cover 251, and at this time, the introduced wash water may be branched to the wash water passages 252*a*, 252*b* and the side portion of the housing 210, respectively, and thus mixed with laundry detergent flowing into the side portion of the housing 210 to move downward by its own weight, and then move through the detergent input hole 214.

The detergent input hole 214 may be disposed at a lower center portion of the housing 210. The detergent input hole 214 is made to communicate with the tub (not shown) of the laundry treating apparatus 100, and thus laundry detergent mixed with wash water may be moved along an inclined lower surface of the housing 210, and then supplied into the tub (not shown) through the detergent input hole 214.

In other words, laundry detergent stored in each storage container 221, 222 may be discharged through a discharge port (not shown) disposed at a rear portion of the each storage container 221, 222 by the operation of the laundry detergent pump 230. and the discharged laundry detergent may be introduced into the housing 210, and mixed with the wash water introduced into the housing 210, and then supplied to the tub (not shown) as shown in an arrow direction of FIG. 6.

Figure 7A:
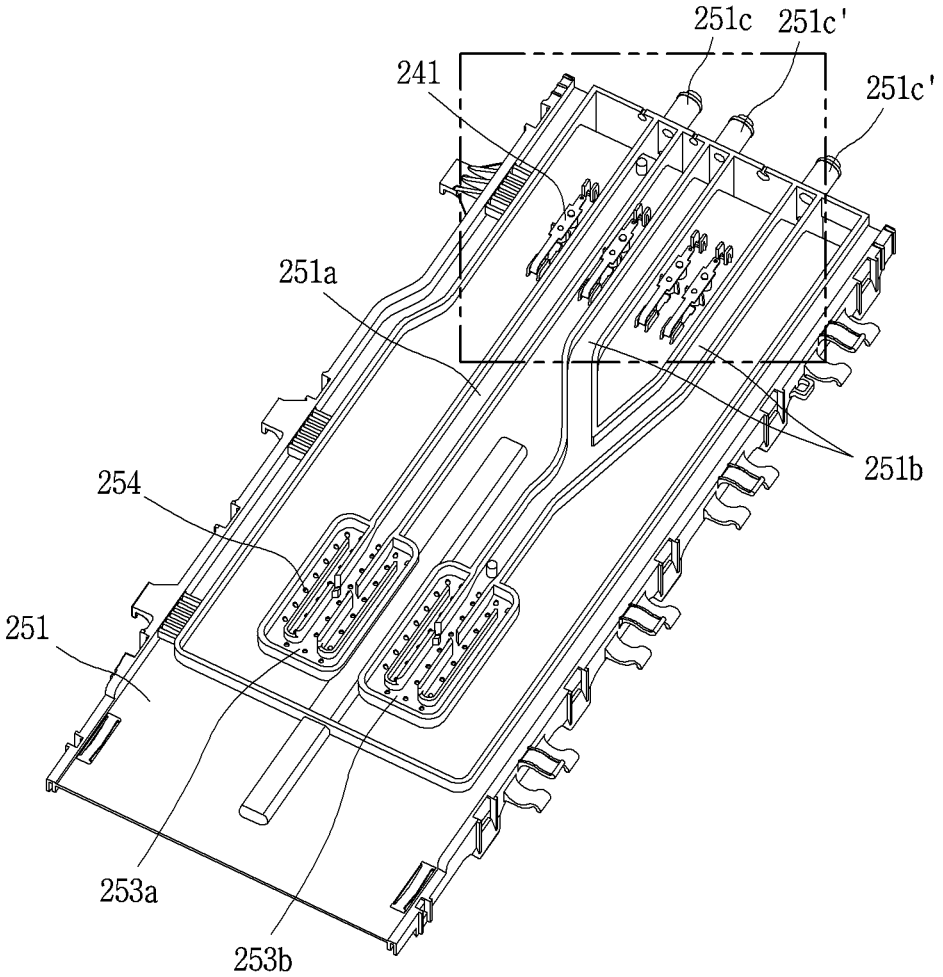
FIG. 7A is a perspective view showing a state of a dispenser cover.
Figure 7B:
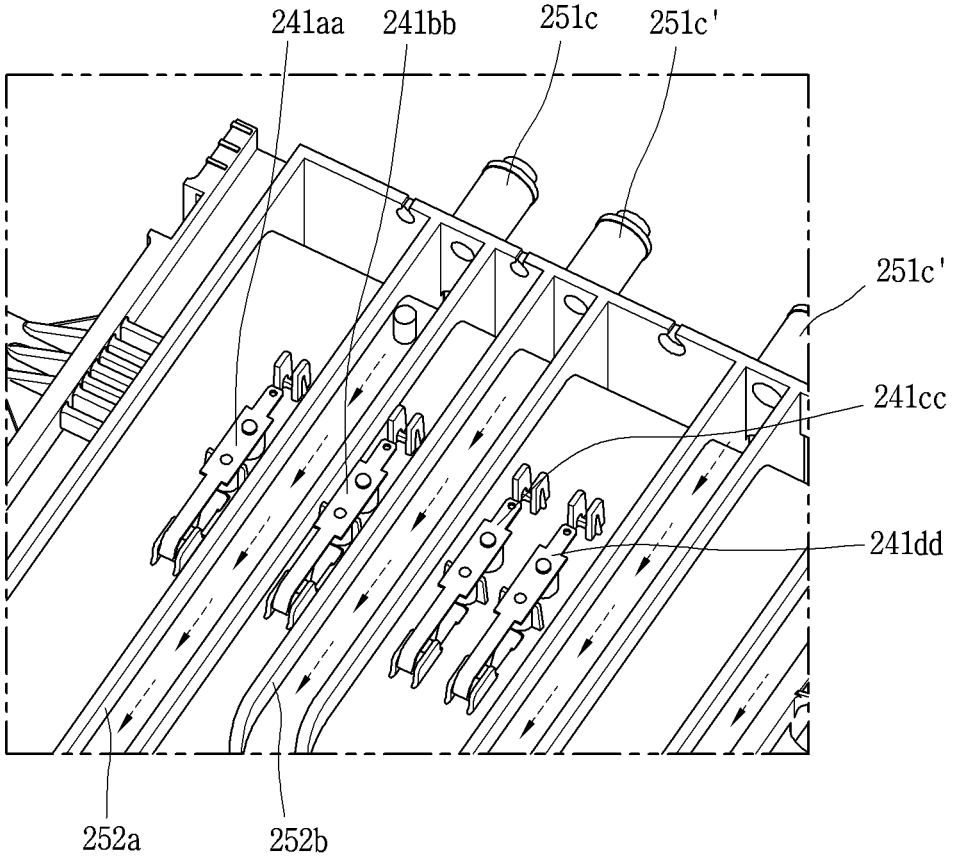
FIG. 7B is an enlarged view in which portion "A" in FIG. 7A is enlarged.
Figure 8A:
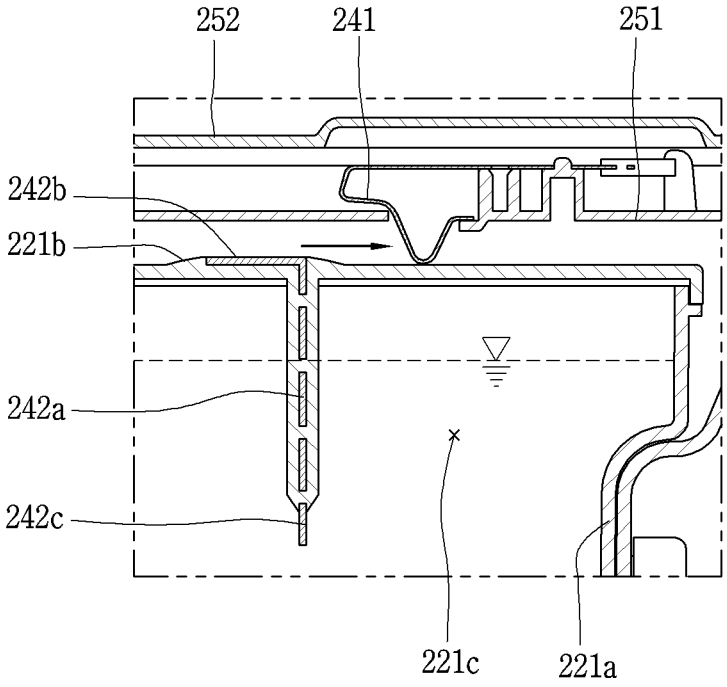
FIGS. 8A and 8B are conceptual views showing a state before and after a terminal and an electrode sensor are in contact with each other.
Figure 8B:
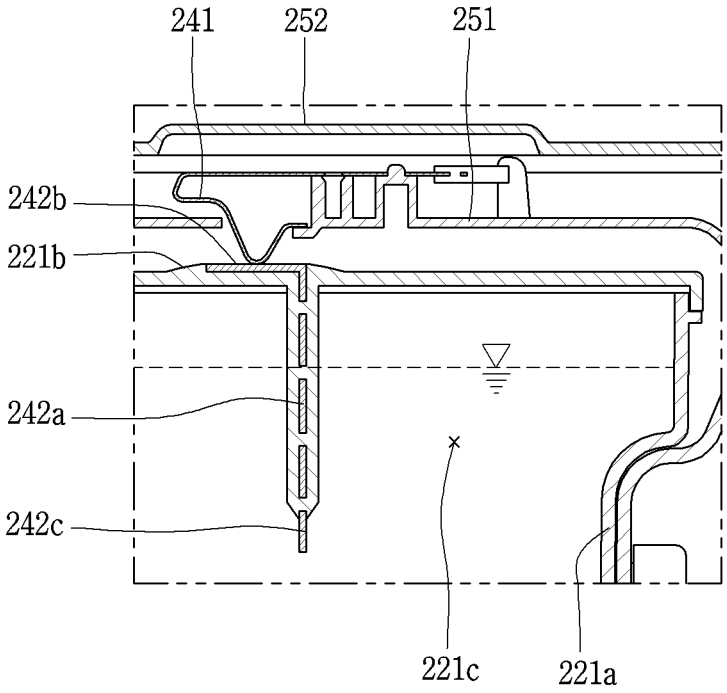

FIG. 7A is a perspective view showing a state of the dispenser cover, and FIG. 7B is an enlarged view in which portion "A" in FIG. 7A is enlarged. FIGS. 8A and 8B are conceptual views showing a state before and after the terminal 241 and the electrode sensor 242 are in contact with each other.

When the detergent supply apparatus 200 is mounted on the main body, the remaining amount sensing unit 240 may be configured to sense a remaining amount of laundry detergent stored in the storage container 221, 222 in a manner of applying a current to each of the storage containers 221, 222, and then measuring the sensed current.

The remaining amount sensing unit 240 may be configured with a terminal 241 and an electrode sensor 242.

Each terminal 241*aa*, 241*bb*, 241*cc*, 241*dd* may be respectively provided at one side of the dispenser cover 251.

As shown in FIG. 7B, different terminals 241*aa*, 241*bb* may be provided at both sides of the first wash water passage 252*a*.

As shown in FIG. 8A, the terminal 241 and the electrode sensor 242 may not be in contact with each other in a state where the detergent supply apparatus 200 is withdrawn from the main body 110, and as shown in FIG. 8B, the terminal 241 and the electrode sensor 242 may be in contact with each other when the housing 210 is pushed to be inserted into the main body 110 so as to couple the detergent supply apparatus 200 to the main body 110.

For example, when the detergent supply apparatus 200 is coupled to the main body 110, each of the different terminals 241*aa* and 241*bb* may be in contact with the different electrode sensors 242, respectively. At this time, two electrode sensors 242 provided at the lid portion 221*b* of the first storage container 221 may be configured to be in contact with the different terminals 241*aa*, 241*bb*.

Each electrode sensor 242 provided at the lid portion 221*b* of the first storage container 221 may be configured to extend in a vertical direction, and may be in contact with each terminal 241*aa*, 241*bb* when laundry detergent (e.g., fabric softener or liquid detergent) stored in the first storage container 221 is above a predetermined capacity. In this case, when a current is applied to one terminal 241*aa*, the other terminal 241*bb* may sense a current flowing between each electrode sensor 242 and laundry detergent, thereby sensing whether laundry detergent (fabric softener or liquid detergent) above a predetermined amount is stored in the first storage container 221.

If laundry detergent (e.g., fabric softener or liquid detergent) stored in the first storage container 221 is below a predetermined capacity, the two different electrode sensors 242 may not be in contact with the laundry detergent, and thus even if a current is applied to the terminal 241*aa*, the current may not be sensed at the other terminal 241*bb*.

In addition, as shown in FIG. 7B, different terminals 241*cc*, 241*dd* may be provided between the second wash water passages 252*b* branched from each other. When the detergent supply apparatus 200 is coupled to the main body 110, each of the terminals 241*cc*, 241*dd* may be in contact with a different electrode sensor 242, respectively.

In this case, two electrode sensors 242 provided in the lid portion 222*b* of the second storage container 222 may be configured so as to be in contact with different terminals 241*aa*, 241*bb*.

Different electrode sensors 242 provided at the lid portion 222*b* of the second storage container 222 may be configured to extend in a vertical direction, and thus provided to be in contact with the terminals 241*aa*, 241*bb*, respectively, when laundry detergent (e.g., liquid detergent or fabric softener) stored in the second storage container 222 is above a predetermined capacity. In this case, a current may be applied to one terminal 241*cc*, and a current flowing between each electrode sensor 242 and laundry detergent may be applied to the other terminal 241*dd*, thereby sensing whether laundry detergent (liquid detergent or fabric softener) above a predetermined amount is stored in the first storage container 222.

If laundry detergent (e.g., fabric softener or liquid detergent) stored in the second storage container 222 is below a predetermined capacity, the two different electrode sensors 242 may not be in contact with the laundry detergent, and thus even if a current is applied to the terminal 241*cc*, the current may not be sensed at the other terminal 241*dd*.

In other words, the remaining amount sensing unit 240 may be configured to sense a remaining amount of laundry detergent stored in the storage container in a manner of measuring the strength of the current. Specifically, when a current flows between each terminal 241*aa*, 241*bb*, 241*cc*, 241*dd*, each electrode sensor 242, and laundry detergent stored in each storage container 221, 222, it may be possible to determine whether laundry detergent is stored above a predetermined capacity in each storage container 221, 222 through the measured current value.

Figure 9A:
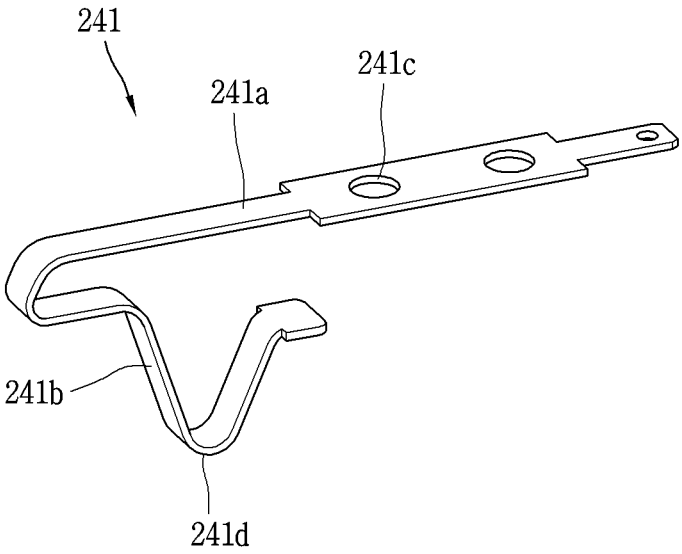
FIG. 9A is a perspective view showing a state of the terminal constituting a remaining amount sensing unit.
Figure 9B:
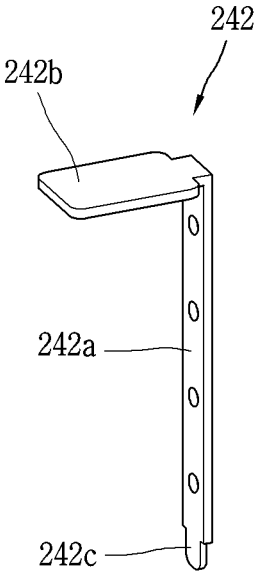
FIG. 9B is a perspective view showing a state of the electrode sensor.

FIG. 9A is a perspective view showing a state of the terminal 241 constituting the remaining amount sensing unit 240, and FIG. 9B is a perspective view showing a state of the electrode sensor 242.

The remaining amount sensing unit 240 may be configured with a terminal 241 and an electrode sensor 242.

The remaining amount sensing unit 240 may include a terminal 241 provided to protrude toward a storage container, and an electrode sensor 242 fixedly provided at a storage container lid portion 221*b*, 222*b* covering the storage container 221, 222, and disposed to extend toward an inside of the storage container 221, 222 to be in contact with the terminal 241 so as to sense a remaining amount of laundry detergent stored in the storage container 221, 222 through a current applied thereto.

A plurality of terminals 241 may be provided at one side of the dispenser cover 251, and one side of the terminal 241 may be provided to protrude from one side of the dispenser cover 251 toward the storage container 221, 222. The terminal 241 may be fixedly provided at one side of the dispenser cover 251 to allow a contact portion 241*d* disposed to protrude from one side of the dispenser cover 251 to be selectively in contact with an upper one side of the electrode sensor 242.

The terminal 241 may include an extension portion 241*a* fixedly provided at the dispenser cover 251, a bending portion 241*b* configured to be bent from an end portion of the extension portion 241*a* toward the storage container 221, 222, and a contact portion 241*d* disposed to protrude from the cover 251 to be in contact with a horizontal portion 242*b* of the electrode sensor 242.

A fastening hole 241*c* may be disposed at the extension portion 241*a* of the terminal 241 to be fixed to the dispenser cover 251.

The electrode sensor 242 may be provided to be coupled to each of the lid portion 221*b*, 222*b* of the first and second storage containers 221, 222. An end of the electrode sensor 242 may be configured to be in contact with the stored laundry detergent, and the other end thereof may sense a remaining amount of laundry detergent stored in the storage container 221, 222 while being in contact with the terminal 241.

The electrode sensor 241 may be fixed to the storage container lid portion 221*b*, 222*b*, and one side of thereof may be configured to be exposed to the outside so that the electrode sensor 241 may include a horizontal portion 242*b* in contact with the contact portion and a vertical portion 242*a* disposed to extend toward an inside of the storage container.

The horizontal portion 242*b* and the vertical portion 242*a* may extend in directions crossing each other, and a lower end portion of the vertical portion 242*a* may be coupled to the electrode 242*c* so that when laundry detergent stored in each storage container 221, 221 is above a predetermined capacity, the electrode 242*c* may be in contact with laundry detergent to sense a remaining amount of laundry detergent stored in the each storage container 221, 222.

The foregoing description is merely embodiments for implementing a laundry treating apparatus according to the present disclosure, and the present disclosure is not limited to the above embodiments, and various modifications and improvements will become apparent to those skilled in the art without departing from the concept and scope of the present disclosure as disclosed in the following claims.

What is claimed is:

1. A laundry treating apparatus, comprising:

a main body;

a tub located inside the main body;

a drum located inside the tub and configured to rotate; and a detergent supply apparatus that is located at one side of the main body, that is configured to be inserted into or withdrawn from a front surface of the main body, and that is configured to supply laundry detergent to the tub, the detergent supply apparatus comprising:

a housing defining an outer appearance of the detergent supply apparatus;

a storage container that extends in a front-rear direction inside the housing and that is configured to store the laundry detergent;

a laundry detergent pump located at a rear portion of the housing and configured to pump the laundry detergent stored in the storage container from the storage container to the tub;

a sensor unit configured to apply current toward an inside of the storage container to sense a remaining amount of the laundry detergent stored in the storage container; and a wash water dispenser located inside the main body and above the housing based on the housing being inserted into the main body, wherein a bottom surface of the wash water dispenser is configured to face an upper portion of the storage container and defines a moving path of wash water flowing in the detergent supply apparatus, wherein the sensor unit comprises:

a terminal that protrudes from the main body toward the storage container; and an electrode sensor located at a storage container lid portion that covers an upper portion of the storage container, wherein one side of the electrode sensor is configured to be in contact with the terminal to transmit the current to the laundry detergent stored in the storage container, and wherein the terminal comprises:

an extension portion located at one side of the wash water dispenser;

a bending portion configured to be bent from the extension portion toward the storage container; and a contact portion disposed to be in contact with the electrode sensor.

2. The laundry treating apparatus of claim 1, wherein the wash water dispenser comprises:

a dispenser cover that includes a wash water passage in a predetermined shape along a surface of the wash water passage to guide flow of wash water through a wash water inlet portion; and a dispenser lid coupled to the dispenser cover and configured to cover an upper portion of the dispenser cover.

3. The laundry treating apparatus of claim 2, wherein the contact portion is configured to protrude through an opening of the dispenser cover and configured to selectively contact the electrode sensor.

4. The laundry treating apparatus of claim 1, wherein the sensor unit comprises a plurality of terminals and a plurality of electrode sensors, each terminal being paired with a respective electrode sensor to transmit the current to the laundry detergent stored in the storage container.

5. The laundry treating apparatus of claim 3, wherein the electrode sensor comprises:

a horizontal portion located at the storage container lid portion, one side of the horizontal portion being exposed and configured to contact the contact portion; and a vertical portion that is connected with the horizontal portion and configured to extend in a direction that is perpendicular to the horizontal portion and toward an inside of the storage container.

6. The laundry treating apparatus of claim 5, wherein the electrode sensor comprises an electrode located at a lower end portion of the vertical portion of the electrode sensor and configured to contact the laundry detergent.

7. The laundry treating apparatus of claim 1, wherein the storage container comprises a first storage container and a second storage container that face each other at one side of the housing, and wherein a manual detergent dispensing unit is disposed between the first storage container and the second storage container and configured to enable manual supply of laundry detergent.

8. The laundry treating apparatus of claim 7, wherein a third detergent container is located on the manual detergent dispensing unit and configured to guide the supply of laundry detergent.

9. The laundry treating apparatus of claim 1, wherein the housing comprises an inclined lower surface to move the laundry detergent, and a detergent input hole disposed at one side of the lower surface of the housing and configured to communicate between the detergent supply apparatus and the tub.

10. The laundry treating apparatus of claim 9, wherein the housing comprises a lower side portion with a predetermined inclination toward the detergent input hole.

11. The laundry treating apparatus of claim 1, wherein a discharge port is located at a rear portion of the storage container and configured to discharge stored laundry detergent by operation of the laundry detergent pump, and wherein the laundry detergent flowing out through the discharge port is mixed with incoming wash water and moved toward the tub.

* * * * *